US010144618B2

(12) United States Patent
Molteni

(10) Patent No.: US 10,144,618 B2
(45) Date of Patent: Dec. 4, 2018

(54) LIFTER WITH ELECTROPERMANENT MAGNETS

(71) Applicant: SGM GANTRY S.P.A., Manerbio (BS) (IT)

(72) Inventor: Danilo Molteni, Manerbio (IT)

(73) Assignee: SGM Magnetics S.p.A., Manerbio (BS) (IT)

( * ) Notice: Subject to any disclaimer, the term of this patent is extended or adjusted under 35 U.S.C. 154(b) by 0 days.

(21) Appl. No.: 15/509,658

(22) PCT Filed: Aug. 18, 2015

(86) PCT No.: PCT/IB2015/056267

§ 371 (c)(1),
(2) Date: Mar. 8, 2017

(87) PCT Pub. No.: WO2016/038487

PCT Pub. Date: Mar. 17, 2016

(65) Prior Publication Data

US 2017/0253464 A1 Sep. 7, 2017

(30) Foreign Application Priority Data

Sep. 9, 2014 (IT) ..... 102014902291551

(51) Int. Cl.
*B66C 1/04* (2006.01)
*B66C 1/06* (2006.01)

(52) U.S. Cl.
CPC ..... *B66C 1/04* (2013.01); *B66C 1/06* (2013.01); *B66C 2700/087* (2013.01)

(58) Field of Classification Search
CPC ..... B23Q 3/1543; H01F 7/206; B66C 2700/087; B66C 1/04; B66C 1/06
See application file for complete search history.

(56) References Cited

U.S. PATENT DOCUMENTS 3,823,395 A * 7/1974 Rigney ..... B66C 23/905 340/531
4,237,455 A 12/1980 Beckley et al.
(Continued)

FOREIGN PATENT DOCUMENTS

CN 1225188 A 8/1999
CN 201923757 U 8/2011
(Continued)

OTHER PUBLICATIONS

International Search Report and Written Opinion for International Application No. PCT/IB2015/056267 (dated Dec. 7, 2015) (9 Pages).
(Continued)

*Primary Examiner* — Stephen A Vu
(74) *Attorney, Agent, or Firm* — Lucas & Mercanti LLP

(57) ABSTRACT

A lifter with electro-permanent magnets is provided. It has an external bearing structure closed at the bottom by a plate, provided with a heat shield, and pole pieces secured under the respective poles and protruding from the bottom plate. Each of the electro-permanent magnets has a reversible magnet arranged on top of one of the poles, of a fixed polarization magnet formed by a plurality of blocks placed along the lateral faces of the pole and of a coil arranged around the reversible magnet to cause the reversal of the polarization of the latter by means of an electrical pulse. An airtight air gap between 1 and 4 mm high is formed between each pole piece and the respective pole through the interposition of a plate of thermal insulation material that resists high temperatures provided at each pole with a rectangular window slightly smaller in size than the pole itself, with the top sides of the pole pieces and/or the bottom sides of the poles being provided with peripheral recesses suitable to act as seats for the positioning of the plate.

24 Claims, 2 Drawing Sheets

(56) References Cited

U.S. PATENT DOCUMENTS

| | | | | |
|---|---|---|---|---|
| 6,104,270 | A * | 8/2000 | Elias | B66C 1/04 335/289 |
| 8,213,149 | B2 * | 7/2012 | Pohl | B25J 15/0052 361/144 |
| 8,919,839 | B2 * | 12/2014 | Molteni | H01F 7/206 294/65.5 |
| 9,453,769 | B2 * | 9/2016 | Michael | B23Q 3/15 |

FOREIGN PATENT DOCUMENTS

| | | | |
|---|---|---|---|
| CN | 202575668 | U | 12/2012 |
| CN | 204015082 | A | 9/2014 |
| EP | 0929904 | B1 | 12/2000 |
| FR | 2616006 | A1 | 12/1988 |
| JP | H10231084 | A | 9/1998 |
| WO | 9908293 | A1 | 2/1999 |
| WO | 2014083469 | A1 | 6/2014 |

OTHER PUBLICATIONS

English Translation of Chinese Office Action for Corresponding Chinese Application No. 201580048607. (7 Pages) (dated Oct. 9, 2017).

* cited by examiner 3
6
8
2
N
S
N
S
7
5
1
9
6
8
1
9
10
5
11
12
4
7
13

LIFTER WITH ELECTROPERMANENT MAGNETS

CROSS-REFERENCE TO RELATED APPLICATIONS

This application is a 371 of PCT/IB2015/056267, filed Aug. 18, 2015, which claims the benefit of Italian Patent Application No. 102014902291551, filed Sep. 9, 2014.

FIELD OF THE INVENTION

The present invention relates to magnetic lifters, and particularly to a lifter with electro-permanent magnets capable of operating safely for a long time also on ferromagnetic materials at high temperatures up to 600-650° C. such as billets, blooms, slabs and similar steel mill products.

BACKGROUND OF THE INVENTION

It is known that magnetic lifters are divided into three classes depending on the type of magnets employed, i.e. permanent magnets, electromagnets and electro-permanent magnets, each type of magnets having its own advantages and drawbacks.

The lifters with permanent magnets have the advantage of an almost negligible power consumption and of a produced magnetic force which is reliably constant and independent of outer supply sources. On the other hand, it is not possible to increase the magnetic force if necessary and the magnets are exceedingly bulky for lifting heavy loads. Furthermore, the load release requires the application of a considerable mechanical power in order to create an air gap between the lifter and the load large enough to reduce the magnetic force to a value smaller than the load weight. Alternatively, the magnets have to be made movable so that they can be moved away from the load, thus decreasing the magnetic attraction, or it is necessary to provide compensator coils to temporarily generate in the load a magnetic flux opposite to the magnetic flux generated by the permanent magnets, as in FR 2616006.

On the contrary, in the lifters with electromagnets it is possible to freely vary the magnetic force by simply adjusting the current flowing in the windings which generate the magnetic field. However, any breakdown, even if very short, of the power supply immediately cancels the magnetic force and thus causes the release of the load. It is therefore evident that safety systems ensuring the supply continuity are essential.

The lifters with electro-permanent magnets succeed in overcoming the main drawbacks of the two above-described types of lifters by combining fixed polarization permanent magnets with permanent magnets of the reversible type, i.e. magnets in which the polarization is easily reversed through the application of an electrical pulse. When the polarization of the magnetic masses, fixed and reversible, results in a North-South-North-South series the magnetic flux is short-circuited within the lifter thus making the latter inoperative, whereas when the polarization of the reversible magnets is in opposition, i.e. in parallel North-South-South-North, the magnetic flux splits up passing through the polar pieces into the ferromagnetic material to be moved and the lifter is operative. The reversible magnet thus generates an adjustable magnetic flux which can also direct the flux of a conventional non-reversible permanent magnet combined therewith, so as to short-circuit the two magnets when the lifter is to be deactivated or arrange them in parallel for activating the lifter.

Since just an electrical pulse but not a continuous supply is needed for reversing the reversible magnet, the safety problems affecting electromagnets are prevented. At the same time, even though permanent magnets are used, it is possible to vary the magnetic force within some limits, and the load release is easy to carry out with a minimum power consumption and without complex structures for moving the magnets.

However, the lifters with electro-permanent magnets manufactured until today have significant use restrictions as far as the temperature of the material that can be safely lifted is concerned. In fact the reversible magnets are usually made of an aluminium-nickel-cobalt alloy (Alnico) that has a Curie point of about 800° C., while the fixed polarization magnets are made of neodymium or ferrite that have a Curie point of about 310° C. and 450° C. respectively. This means that lifters with electro-permanent magnets of Alnico-neodymium operate without problems on ferromagnetic materials with temperatures not greater than 150-200° C., whereas those with magnets of Alnico-ferrite can operate on materials up to 350-400° C.

Moreover also the commutation coils that control the reversal of the polarization of the reversible magnets have their own maximum operating temperature, whereby upon achievement of even one of these three maximum temperatures (coils, fixed and reversible magnets) the lifter must be put to rest to cool down in order to ensure the integrity of the same, and the safety of the lifting and transport operations of the hot ferromagnetic products.

In practice this means that even a lifter provided with the best fixed polarization magnets of a samarium-cobalt alloy, which has a Curie point of about 770° C., must be put to rest after about two hours of operation in the handling of ferromagnetic materials at 600° C. with a 60% operating cycle (i.e. 60% of the time in contact with the hot material and 40% not). In fact after this time of operation the average temperature of the fixed SmCo magnets is about 350° C., which is also the limit temperature recommended by the manufacturers of such material, the temperature of the reversible Alnico magnets reaches 340° C. and the commutation coils have an average temperature of 180° C., which is also close to the temperature limit.

This also depends on the fact that in traditional lifters the pole pieces are fixed to the poles with the circuit surfaces perfectly in contact with each other, i.e. without air gap, to reduce magnetic circuit leakage thus minimizing the magnetic reluctance. This arrangement, however, also facilitates the transmission of heat towards the interior of the lift when it is used in the lifting and transport of steel mill products with temperatures varying between 400° C. and 650° C. As explained above, this heat transmission considerably reduces the operating time of the lifter because it leads to risky temperatures in relatively short times in its critical components namely, in chronological order, the fixed magnets, the reversible magnets and the commutation coils.

SUMMARY OF THE INVENTION

Therefore it is an object of the present invention to provide a lifter with electro-permanent magnets that overcomes the above-mentioned drawbacks. Such an object is achieved by means of a lifter in which the pole pieces are not in contact with the poles (i.e. the air gap is not zero) since airtight air gaps are present between the pole pieces and the poles so as to reduce greatly and for guaranteed times the transmission of heat from the hot materials to the above-mentioned heat-sensitive critical components. Other advantageous characteristics are recited in the dependent claims.

The main advantage of this lifter is therefore that of being able to significantly increase the range of the continuous safe operation up to times much higher than those that can be reached by present lifters with electro-permanent magnets so as to guarantee at least an operability over an 8-hour shift in a steel mill hot area.

Another important advantage of the lifter according to the present invention is provided by its structural simplicity, which makes it reliable and suitable also for the upgrade of existing lifters.

BRIEF DESCRIPTION OF THE DRAWINGS

Further advantages and characteristics of the lifter according to the present invention will be clear to those skilled in the art from the following detailed description of an embodiment thereof, with reference to the annexed drawings wherein.

DETAILED DESCRIPTION OF THE INVENTION

Figure 1:
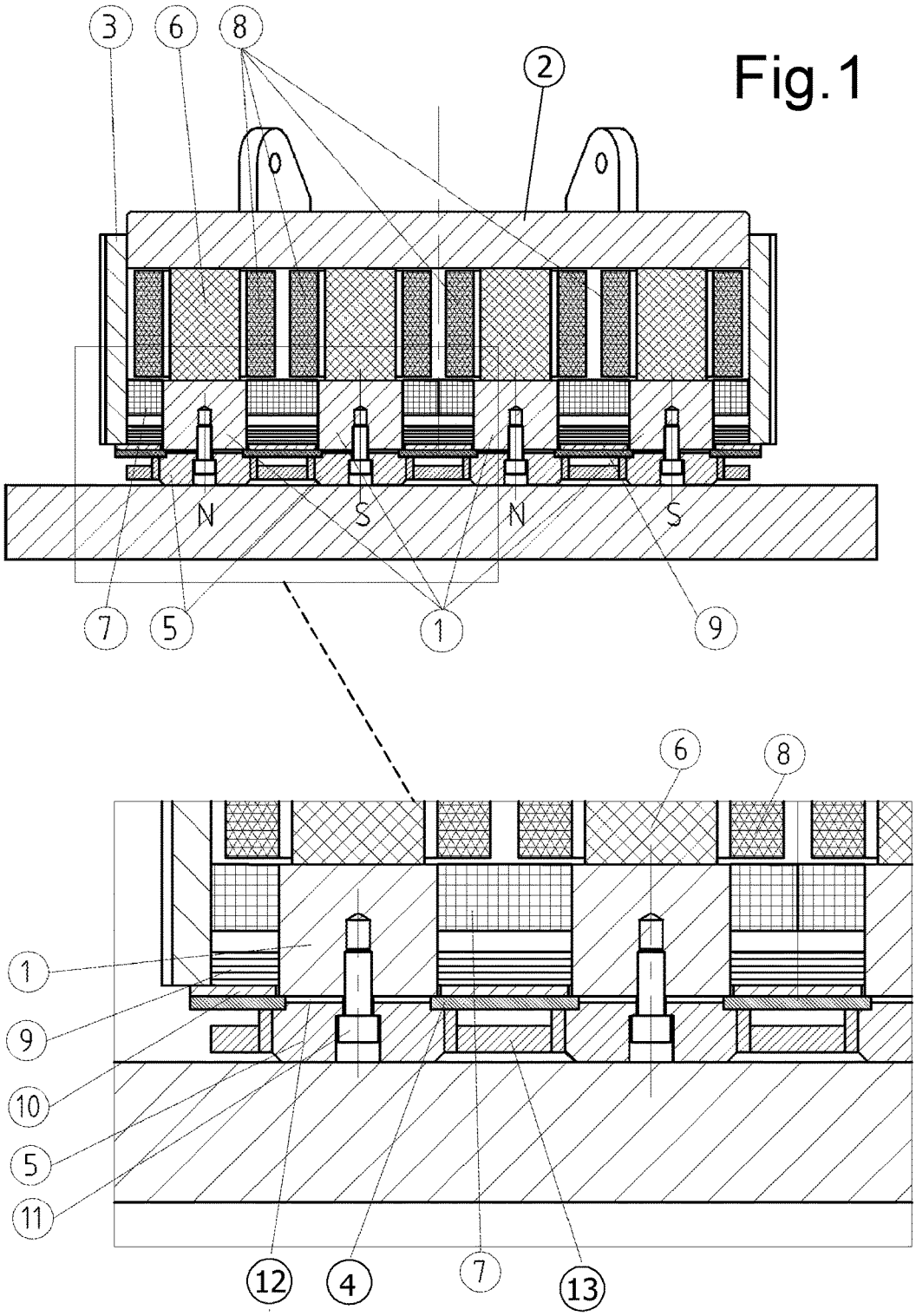
FIG. 1 is a transverse cross-sectional view along the midplane of a lifter according to the present invention, resting on a load to be lifted, with an enlarged detail.
Figure 2:
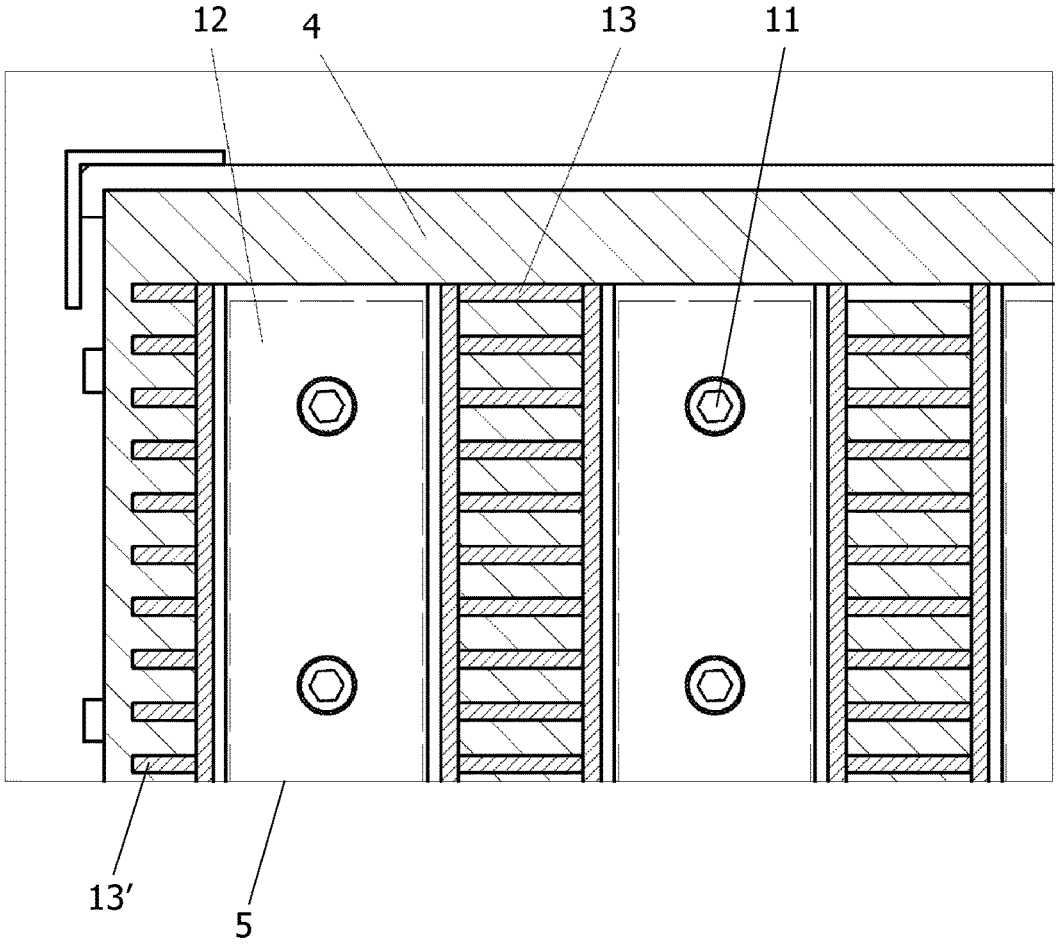
FIG. 2 is an enlarged detail of a bottom plan view of a corner of the lifter of FIG. 1.

With reference to these figures, there is seen that a lifter with electro-permanent magnets according to the present invention conventionally includes an external bearing structure, a plurality of electro-permanent magnets and an adjustment and control circuit.

The bearing structure consists of a top cover 2, provided with couplings for the connection to lifting means (e.g. a crane), two peripheral walls 3 and a bottom closure plate 10 provided with a heat shield 9 to protect the magnets from the heat radiated by the hot ferromagnetic materials to be lifted. Said structure is obviously made of high magnetic conductivity materials, typically carbon mild steel, in order to minimize the reluctance of the magnetic circuit, same as the circuit poles 1 and the pole pieces 5, intended to contact the load to be lifted, which protrude below the closure plate 10 and are secured to poles 1 through screws 11.

Each of the electro-permanent magnets includes a reversible magnet 6, arranged on top of a pole 1 and in contact therewith, and a fixed polarization magnet 7 formed by a plurality of blocks placed along the lateral faces of said pole 1. Around the reversible magnet 6 there is arranged a commutation coil 8 that controls the reversal of the polarization thereof, to commute between the condition of inoperative lifter illustrated in FIG. 1 with the poles in series North-South-North-South and the condition of operative lifter with the poles in parallel North-South-South-North.

The adjustment and control circuit preferably includes a device of the type described in EP 0929904 B1. In brief, said device includes for each polarity a first magnetic sensor arranged close to the base of pole 1 and a second magnetic sensor arranged between the fixed magnet 7 and the reversible magnet 6, so as to measure substantially only the magnetic flux passing through the reversible magnet 6, as well as a control unit for processing the signals transmitted by said magnetic sensors (not shown in the drawings) and obtaining the operating point of the lifter on the magnetization curve of the reversible magnet 6.

The above device guarantees absolute safety during any load lifting and transporting operation by checking that the sum of the reversible losses of the magnetic masses 6, 7 and of the decrease in magnetic permeability of the ferromagnetic circuit of the lifter, and in particular of the hot material to be lifted, still allows the lifter to attain the lifting safety coefficient according to the EN 13155 standard (or another similar standard applied in other countries).

Such a device also monitors the efficiency of coils 8 that are preferably made of an aluminium strip or a copper strip so as to minimize their volume and to optimize the thermal dissipation due to Joule effect. Coils 8 are designed such that they can operate correctly with reversal pulses that are either constant in current or constant in voltage, although given the critical operating conditions of high temperature of the material it is preferable to use a constant current apparatus.

The adjustment and control circuit employs also the signals of thermal probes (not shown in the drawings) extending inside the various critical components of the lifter to check that it is possible to perform safely the operations.

Turning now to the specific novel aspects of the present lifter, the applicant has found that for the particular application for which the present lifter is intended it is advantageous to have the pole pieces 5 not in contact with poles 1 but leaving a small air gap, even if this implies an increase in the magnetic reluctance of the circuit and an increased magnetic circuit leakage. Overcoming this rooted technical prejudice, the applicant has verified through tests that at the operating temperatures requested to the lifter to operate on ferromagnetic materials at high temperatures up to 600-650° C., the disadvantage due to the increased magnetic reluctance is substantially offset by the reduced transmission of heat through the air gap which allows it to operate with the same loads of a traditional lifter but for much longer times without having to put it to rest after a couple of hours to let it cool down.

More specifically, returning to the example mentioned above of a traditional lifter equipped with fixed polarization magnets of samarium-cobalt alloy which moves the ferromagnetic material at 600° C. with a 60% operating cycle, after two hours of operation its maximum strength lifting was reduced to 44% compared to 100% which it had at 20° C. at the start of the operation. Furthermore, the temperatures reached by the critical elements prevent to continue to safely use the lifter that must be put to rest to cool down.

A lifter according to the present invention, which faces the same operating conditions and is provided with airtight gaps 2 mm high, initially starts with a maximum force at 20° C. reduced to 82% due to the air gap but after two hours of operation still retains 43% of the force. This means that despite the air gap of 2 mm, thanks to the presence of the airtight air gaps, the reduction of losses due to the heating of the magnetic masses after two hours of operation limits the difference between the forces of the two lifters to 1% against the initial 18% (and taking into account the safety factor of 3 of EN 13155 this difference in practice is 0.33% and 6% respectively).

However, the present lifter is still able to operate safely, as opposed to a traditional lifter, as shown by the following table which shows the temperature increase of the critical elements that even after 16-18 hours of operation have not yet reached the limit values, so that the lifter still retains about 38% of the force.

| Time (h) | Temperature SmCo (° C.) | Temperature Alnico (° C.) | Temperature coils (° C.) |
|---|---|---|---|
| 2 | 106 | 90 | 65 |
| 6 | 200 | 180 | 140 |
| 8 | 229 | 207 | 160 |
| 16 | 281 | 255 | 180 |
| 18 | 286 | 260 | 182 |

The enclosed drawings show the preferred embodiment or best mode of the invention in which the airtight air gaps are obtained by interposing between the pole pieces 5 and poles 1 a plate 4 of thermal insulation material resistant to high temperatures, for example a laminated material commercially known as Pamitherm and consisting of sheets of muscovite coupled by means of silicone resin. In correspondence of each pole 1 there has been formed in plate 4 a rectangular window of a size slightly smaller than the pole itself, while in the top sides of the pole pieces 5 and/or in the bottom sides of poles 1 peripheral recesses were obtained, for example 7-12 mm wide and 3-6 mm high, which form seats for the positioning of plate 4.

Subsequently, the magnetic poles 1, the pole pieces 5 and plate 4 have been brought to a temperature of at least 150° C. to eliminate any presence of moisture and the mounting screws 11 of pieces 5 have been tightened so as to compress adequately plate 4 such that it acts as a gasket for the airtight sealing of the air gaps 12 thus formed. These air gaps 12, which are preferably between 1 and 3 mm high depending on the temperatures and on the operating times, greatly reduce the transmission of heat received from the lifted material at temperatures up to 650° C. thanks to the extremely low thermal conductivity of dry air that is around $\lambda=0.026\ W*m^{-1}*K^{-1}$.

The material of which plate 4 is composed can operate between 450° C. and 800° C., has a resistance to compression ≥300 MPa and a very low thermal conductivity $\lambda=0.18\ W*m^{-1}*K^{-1}$ (although materials with $\lambda$ up to $0.32\ W*m^{-1}*K^{-1}$ are suitable). The temperature values in the above table were obtained using a lifter according to the preferred embodiment comprising a plate 4 having these parameters.

The typical size of a magnetic pole 1 is preferably included between 200 and 350 mm in width and between 800 and 1400 mm in length, and in the illustrated embodiment the portion of plate 4 compressed between pieces 5 and poles 1 forms a frame 10 mm wide and 5 mm high that although being of reduced area transmits heat more readily since it has a thermal conductivity about 7 times higher than the dry air of the airtight air gap 12. To minimize this amount of heat it is preferable to install heat sinks 13 between the pole pieces 5, below plate 4 of heat-insulating material, each heat sink 13 being formed by a plurality of transverse elements arranged between a pair of longitudinal elements which extend along the opposite side walls of two adjacent pole pieces 5. Note that half-sized heat sinks 13' are arranged also on the outer side walls of the outermost pieces 5 to achieve maximum efficiency in heat dissipation, and that heat sinks 13, 13' are preferably made of copper whose thermal conductivity coefficient is $\lambda=390\ W*m^{-1}*K^{-1}$.

A lifter with electro-permanent magnets thus manufactured and operated is therefore capable of safely moving for long periods materials such as billets, blooms, slabs, etc. at a temperature of 600-650° C. and is therefore suitable for the discharge operating cycle of the cooling plates located at the outlet of the hot rolling line of said products in a steel mill.

It is obvious that the above-described and illustrated embodiment of the lifter according to the invention is just an example susceptible of various modifications. In particular, the exact number, shape and arrangement of the magnetic polarities may vary depending on the specific application, for example by providing a lifter with a single magnetic dipole or three or more magnetic dipoles rather than the two magnetic dipoles illustrated in the present embodiment.

Moreover the air gaps 12 can be obtained in other ways, for example by arranging between pieces 5 and poles 1 gaskets of suitable material and adequate height housed in specific seats.

The invention claimed is:

1. A lifter comprising:

a plurality of electro-permanent magnets, each electro-permanent magnet having a pole;

an external bearing structure closed at a bottom side by a plate provided with a heat shield; and a plurality of pole pieces, each pole piece being secured beneath a corresponding pole of a respective one of the plurality of electro-permanent magnets, wherein the plurality of pole pieces protrude from said plate;

wherein each of the plurality of pole pieces is separated from the corresponding pole to which it is secured by an airtight air gap.

2. The lifter according to claim 1, wherein the airtight air gap provides a separation between the pole piece and the corresponding pole that is between 1 and 4 mm.

3. The lifter according to claim 1, wherein:

a second plate is disposed between the plurality of pole pieces and the poles;

the second plate comprises a thermal insulation material that resists high temperatures;

the second plate includes a plurality of openings, each opening being located proximate a respective pole and being smaller in size than the respective pole, each opening forming a respective airtight air gap between the respective pole and a corresponding pole piece; and the pole pieces and/or the poles are provided with peripheral recesses disposed on a side proximate the second plate, the peripheral recesses being adapted to function as seats for positioning of the second plate.

4. The lifter according to claim 3, wherein the peripheral recesses are between 7 and 12 mm wide and between 3 and 6 mm high or 10 mm wide and 5 mm high.

5. The lifter according to claim 4, further comprising heat sinks optionally made of copper, arranged between the pole pieces and under the second plate of thermal insulation material.

6. The lifter according to claim 5, wherein each heat sink comprises a plurality of transverse elements arranged between a pair of longitudinal elements extending respectively along opposite side walls of two adjacent pole pieces.

7. The lifter according to claim 4, further comprising an adjustment and control circuit comprising thermal probes.

8. The lifter according to claim 3, further comprising heat sinks optionally made of copper, arranged between the pole pieces and under the second plate.

9. The lifter according to claim 8, wherein each heat sink comprises a plurality of transverse elements arranged between a pair of longitudinal elements extending respectively along opposite side walls of two adjacent pole pieces.

10. The lifter according to claim 3, further comprising an adjustment and control circuit comprising thermal probes.

11. A method of manufacturing the lifter with electro-permanent magnets according to claim 3, comprising:

heating the poles, the pole pieces and the second plate to a temperature of at least 150° C. so as to eliminate moisture; and securing the pole pieces on the poles with mounting screws tightened sufficiently to compress the second plate such that it acts as a gasket that forms an airtight seal for the air gaps.

12. The lifter according to claim 3, wherein the thermal insulation material is suitable to operate between 450° C. and 800° C., has a compression resistance greater than or equal to 300 MPa and a thermal conductivity between 0.18 and 0.32 $W*m^{-1}*K^{-1}$.

13. The lifter according to claim 12, wherein the peripheral recesses are between 7 and 12 mm wide and between 3 and 6 mm high or 10 mm wide and 5 mm high.

14. The lifter according to claim 12, further comprising heat sinks optionally made of copper, arranged between the pole pieces and under the second plate.

15. The lifter according to claim 14, wherein each heat sink comprises a plurality of transverse elements arranged between a pair of longitudinal elements extending respectively along opposite side walls of two adjacent pole pieces.

16. The lifter according to claim 12, further comprising an adjustment and control circuit comprising thermal probes.

17. The lifter according to claim 12, wherein the thermal insulation material comprises a laminated material made up of muscovite sheets coupled through silicone resin.

18. The lifter according to claim 17, wherein the peripheral recesses are between 7 and 12 mm wide and between 3 and 6 mm high or 10 mm wide and 5 mm high.

19. The lifter according to claim 17, further comprising heat sinks optionally made of copper, arranged between the pole pieces and under the second plate.

20. The lifter according to claim 19, wherein each heat sink comprises a plurality of transverse elements arranged between a pair of longitudinal elements extending respectively along opposite side walls of two adjacent pole pieces.

21. The lifter according to claim 17, further comprising an adjustment and control circuit comprising thermal probes.

22. The lifter according to claim 1, further comprising:

a second plate comprising thermal insulation material, the second plate being disposed between the plurality of pole pieces and the poles; and heat sinks optionally made of copper, arranged between the pole pieces and under the second plate.

23. The lifter according to claim 22, wherein each heat sink comprises a plurality of transverse elements arranged between a pair of longitudinal elements extending respectively along opposite side walls of two adjacent pole pieces.

24. The lifter according to claim 1, further comprising an adjustment and control circuit comprising thermal probes.

* * * * *